US008241182B2

(12) United States Patent
Julskjaer et al.

(10) Patent No.: US 8,241,182 B2
(45) Date of Patent: Aug. 14, 2012

(54) PLAYGROUND EQUIPMENT

(75) Inventors: Niels Julskjaer, Ringe (DK); Karin Mueller, Middelfart (DK); Peter Christian Raaby Gronfeldt, Aarhus C (DK); Minh Thanh Nguyen, Odense C (DK); Hans Jorgen Meyer Ibsen, Ringe (DK); Michael Philip Laris, Odense C (DK); Michael Stahl, Middelfart (DK)

(73) Assignee: Kompan A/S, Odense (DK)

( * ) Notice: Subject to any disclaimer, the term of this patent is extended or adjusted under 35 U.S.C. 154(b) by 394 days.

(21) Appl. No.: 12/010,947

(22) Filed: Jan. 31, 2008

(65) Prior Publication Data

US 2009/0197740 A1 Aug. 6, 2009

(51) Int. Cl.
*A63B 71/00* (2006.01)

(52) U.S. Cl. ..... 482/8; 482/35

(58) Field of Classification Search ..... 482/1–9, 482/35–37; 434/247, 257
See application file for complete search history.

(56) References Cited

U.S. PATENT DOCUMENTS

| | | | | |
|---|---|---|---|---|
| 5,078,389 | A * | 1/1992 | Chen | 482/8 |
| 5,392,202 | A | 2/1995 | Herron | |
| 5,422,521 | A * | 6/1995 | Neer et al. | 307/119 |
| 5,591,104 | A * | 1/1997 | Andrus et al. | 482/7 |
| 5,667,459 | A * | 9/1997 | Su | 482/4 |
| 5,740,321 | A * | 4/1998 | Huffmann et al. | 706/61 |
| 5,810,696 | A * | 9/1998 | Webb | 482/52 |
| 5,888,172 | A * | 3/1999 | Andrus et al. | 482/7 |
| 5,902,214 | A * | 5/1999 | Makikawa et al. | 482/4 |
| 6,095,950 | A | 8/2000 | Katz | |
| 6,110,073 | A * | 8/2000 | Saur et al. | 482/8 |
| 6,227,968 | B1 * | 5/2001 | Suzuki et al. | 463/7 |
| 6,231,451 | B1 | 5/2001 | Briggs | |
| 6,645,126 | B1 * | 11/2003 | Martin et al. | 482/54 |
| 7,001,311 | B2 | 2/2006 | Frank | |
| 7,374,522 | B2 * | 5/2008 | Arnold | 482/146 |
| 7,608,016 | B2 * | 10/2009 | Beyzavi-Armani et al. | 482/8 |
| 2002/0158751 | A1 * | 10/2002 | Bormaster | 340/10.2 |
| 2004/0198517 | A1 * | 10/2004 | Briggs | 472/128 |
| 2005/0239611 | A1 * | 10/2005 | Commisso | 482/93 |
| 2007/0042867 | A1 * | 2/2007 | Lin | 482/8 |
| 2007/0049384 | A1 * | 3/2007 | King et al. | 472/59 |
| 2007/0219050 | A1 * | 9/2007 | Merril | 482/1 |
| 2007/0254778 | A1 * | 11/2007 | Ashby | 482/5 |
| 2008/0287263 | A1 * | 11/2008 | Cheng | 482/9 |

FOREIGN PATENT DOCUMENTS

WO WO 2006/040404 A1 4/2006

OTHER PUBLICATIONS

International Search Report issued in International Patent Application No. PCT/EP2009/050067; mailed Oct. 21, 2009.

* cited by examiner

*Primary Examiner* — Loan Thanh
*Assistant Examiner* — Daniel F. Roland
(74) *Attorney, Agent, or Firm* — Oliff & Berridge, PLC

(57) ABSTRACT

A playground system includes a playground appliance and a processing unit. The processing unit is adapted to receive a sensor signal from the sensor indicative of the detected movement, and to control the display to indicate a user-selection responsive to the received sensor signal.

19 Claims, 6 Drawing Sheets

PLAYGROUND EQUIPMENT

TECHNICAL FIELD

The present invention relates to playground equipment, and particularly electronically controlled playground equipment.

BACKGROUND

Playgrounds provide popular recreational activities for their users. A playground system typically comprises a number of playground appliances such as swings, slides, seesaws, playground structures on which users can climb or play, etc. or perform another physical activity. Generally, it is desirable that playgrounds encourage physical activity and thus contribute to the prevention of obesity. Often playgrounds are even equipped with playground appliances for activities that aim at promoting cognitive, motoric and social development and education in an attractive and amusing way. Playgrounds are often unmanned and freely accessible for regular visits by players.

Examples of playground structures may include a frame or other support structure and floors, platforms, connecting beams, etc. defining a variety of play elements and/or areas. Slides, tunnels, net bridges, ladders, ropes, bars, beams, etc. may be used to interconnect the various play elements and play areas so that play participants can traverse from one play element or area to the next. Hence, for the purpose of the present description the term playground system is intended to comprise any system comprising one or more playground appliances for providing playful physical activities to a playground user. Playground users may include any age-group of users, such as children, young adults, and/or grown-ups. Playground systems include systems for indoor and/or outdoor use.

Generally, playground appliances should be robust and durable as they may be exposed to varying weather conditions, humidity, sand, dirt and dust, varying temperatures, harsh treatment and even vandalism. At the same time it is generally desirable to maintain low production costs.

Traditional playgrounds have been purely mechanical and "passive" installations, i.e. the various play elements are normally static or react only to forces imparted directly by the play participants.

More recently, there has been a trend towards playgrounds that provide additional interactive elements, in particular play elements whose functions may be triggered, controlled, or otherwise influenced by the users of the playground, so as to provide a play structure that is "active" or "interactive" and allows play participants to operate and control any one of a number of play elements. Such playgrounds stimulate the development of creative thinking or individual problem solving abilities or even encourage group cooperation and team work to achieve a common goal.

U.S. Pat. No. 6,231,451 discloses a play structure including a number of play elements disposed at various locations and elevations throughout the play structure. Each play element can be activated or operated by one or more play participants to complete one of several necessary steps in a chain of triggering events in which kinetic energy is transferred from one play element to the next. The overall completion of the chain of events results in a common desired result or effect, such as a domino-like cascade of various mechanisms, balls, water and/or the like. Play participants achieve the final goal through a collective team effort requiring the coordinated completion of several smaller objectives comprising each necessary step in the chain of triggering events.

It is further desired to make such interactive playgrounds attractive even for older children, young adults, and even adults.

The use of electronically controlled play elements allows a further increased variety of interactive play scenarios. Accordingly playground equipment has been proposed that includes sensors adapted to generate inputs to a signal processing entity that collects and processes information about what the players are doing.

However, the use of electronically controlled playground appliances may reduce the activity level of the playground users as the users may spend an increasing time exploring the different ways of configuring the electronic equipment rather than being physically active.

SUMMARY

According to a first aspect, disclosed herein is a playground system that comprises a playground appliance and a processing unit. Embodiments of the playground appliance comprise:

- a display operationally connected to the processing unit and adapted to display one or more user-selectable items;
- a support structure for securing at least a part of the playground appliance to a surface;
- a support member for receiving/supporting a user of the playground appliance, wherein the support member is movably arranged relative to the support structure responsive to a kinetic energy imparted by the user;
- a sensor operationally connected to the processing unit and adapted to detect a movement of the support member.

In embodiments of the playground system the processing unit is adapted to receive a sensor signal from the sensor indicative of the detected movement, and to control the display to indicate a user-selection responsive to the received sensor signal.

Hence a playground appliance is disclosed that fosters physical activity of the user even during operation of the user interface, e.g. during setting up the functions of an activity to be played.

The display may be a computer monitor, a liquid crystal display, a dot matrix display, or any other suitable type of display.

The support structure may be a base plate to be secured to the floor or ground, to another part of a play structure, or any other suitable support.

The support member may be a platform onto which a user can step, thereby allowing easy and fast access to the user-interface. Alternatively, the support member may be any other suitable device for supporting at least a part of the users weight, preferably at least the user's weight. Examples of such structures include a seat. The movement of the support member my involve a tilt motion, a rotation, a pivoting motion, a translational movement, a torsion or any other movement that can be caused by kinetic energy imparted by the user, e.g. imparted directly on the support member via a force, torque, etc.

The sensor for detecting the motion may be any suitable device or apparatus adapted to detect the movement of the support member, e.g. tilt sensors, Hall effect sensors, accelerometers, force-transducers, e.g. for detecting a force that causes the movement, etc. In some embodiments, in addition to detecting the presence of a movement, the sensor may further be adapted to detect one or more further attributes of the movement, e.g. a direction, speed, degree of displacement, etc.

In some embodiments, the playground appliance further comprises a handle, such as a handle-bar, which the user can hold on to while operating the movable support member, thereby providing improved control and accuracy to the user selection, and increasing the safety of the appliance. In some embodiments, the handle is fixedly arranged relative to the display so as to allow a user to easily observe the display while operating the moveable support member. In one embodiment, the handle is provided in the form of a circumferential handle bar surrounding the display, e.g. in a general plane defined by a display surface of the display, thereby also providing a protection of the display and a protection of the user against bumping into the display.

The user-selectable items may represent options controlling, triggering, or otherwise influencing the operation of electronically controlled play elements of the playground appliance or other playground equipment on the playground. Accordingly, the processing unit may further be adapted to control one or more function of such an electronically controlled play element responsive to the user-selection detected by the playground appliance described herein.

The processing unit may comprise any circuit and/or device suitably adapted to receive the sensor signals and to control the display. In particular, the above term comprises general- or special-purpose programmable microprocessors, Digital Signal Processors (DSP), Application Specific Integrated Circuits (ASIC), Programmable Logic Arrays (PLA), Field Programmable Gate Arrays (FPGA), special purpose electronic circuits, etc., or a combination thereof. It will be appreciated that the processing unit may be embodied as a single control unit or in a distributed manner by a plurality of control units, e.g. at different locations of the playground. The operational connection may be any suitable wired or wireless connection, e.g. a data bus, a serial or parallel interface, a computer network such as a local area network or a wireless local area network, or the like.

Examples of functions of play elements controlled by the control unit include visual, audible, tactile functions, or other user-detectable effects. Further examples include the control of one or more user-interface devices, including one or more user-input devices and/or one or more output devices, according to a predetermined set of rules, e.g. one of a set of game rules. Examples of user-input devices include user-operatable switches, push-buttons, dials, levers, or the like. Examples of user-output devices include devices for providing visual, audible, and/or tactile output such as light sources, sound generators, motors, pumps, etc.

According to a second aspect, disclosed herein is a user-interface element for playground equipment. Embodiments of the user-interface element comprise:

- a housing including a rear surface mountable on a playground appliance;
- a front cover including a convex front surface having a centre axis defining a forward direction, the front surface comprising at least one light-emitting front surface part having a surface normal at an angle relative to the forward direction; wherein said angle is larger than 30 degrees.

Some embodiments of the user-interface element comprise a user-operatable input device for receiving a user input, such as a push-button a dial, a switch, a lever and/or the like. Hence a versatile combined input/output device is provided.

It is an advantage of the user-interface element disclosed herein that the emitted light is visible from a large range of angles and even from the rear of the interface device. This is particularly advantageous when the user-interface is to be used as a part of an interactive playground system that is configurable to provide selective light feedback responsive to user-actions according to a set of pre-determined rules. For example, an interactive activity in relation to the playground system may involve play participants exploring a play structure so as to search for and activate user-interface elements that emit light, light in a certain pattern temporal, of a certain color, and/or the like.

BRIEF DESCRIPTION OF THE DRAWINGS

The above and other aspects will be apparent and elucidated from the embodiments described in the following with reference to the drawing in which.

DETAILED DESCRIPTION

Figure 1:
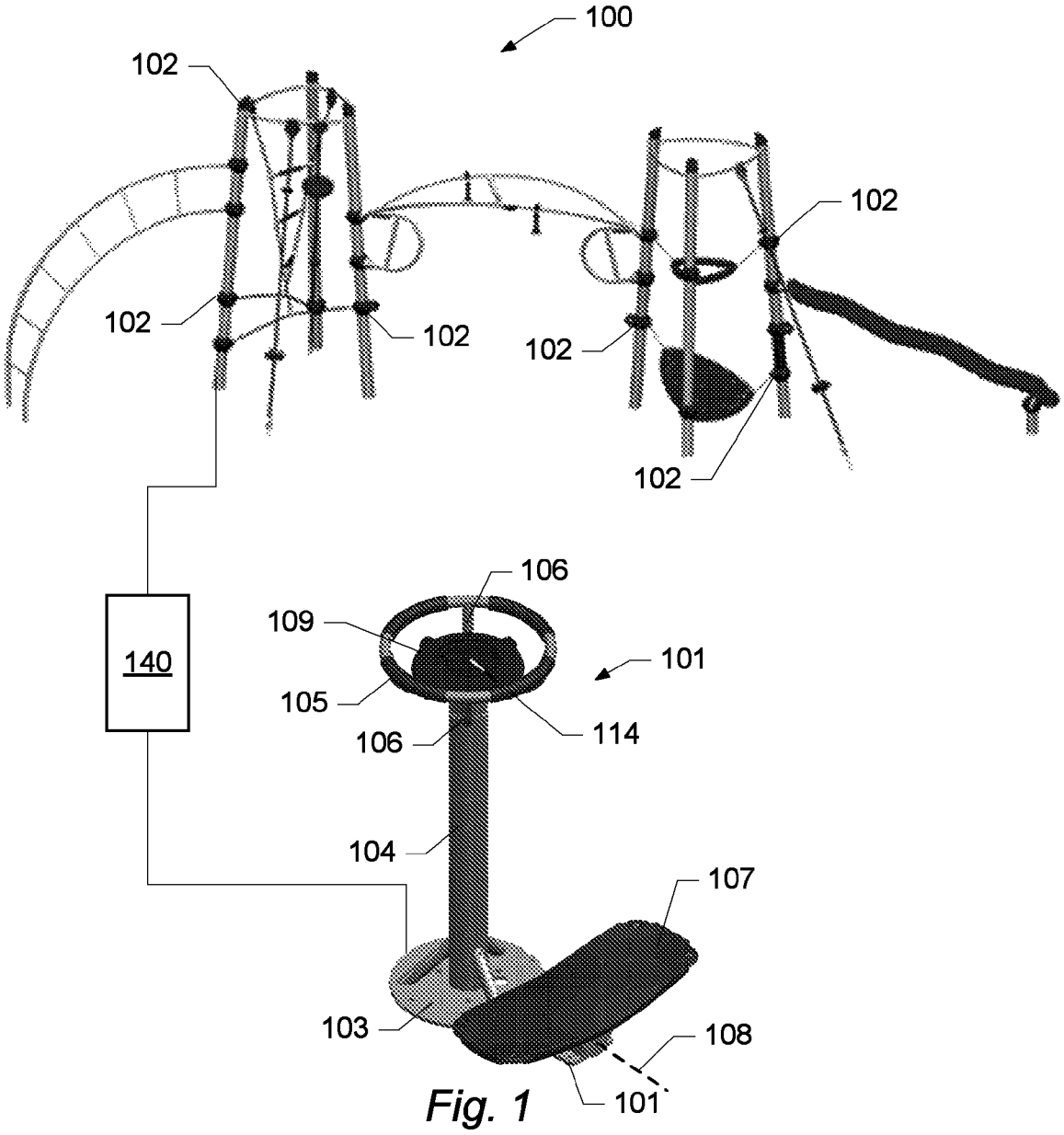
FIG. 1 shows a view of an example of an interactive playground system.
Figure 2A:
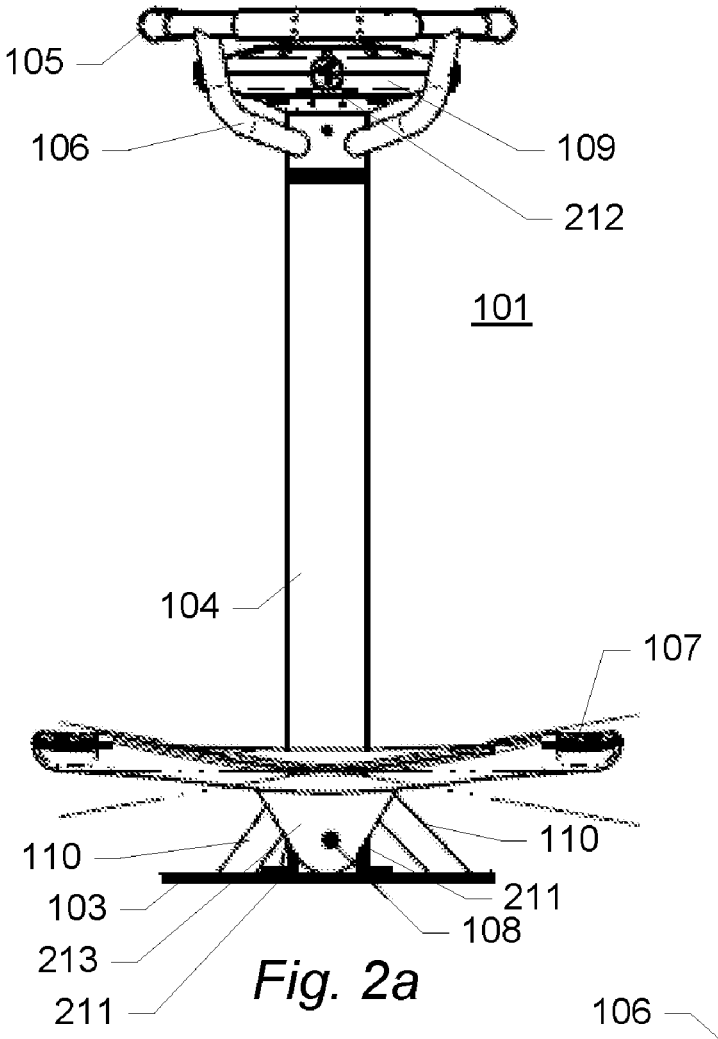
FIGS. 2-4 show examples of playground appliances.
Figure 2B:
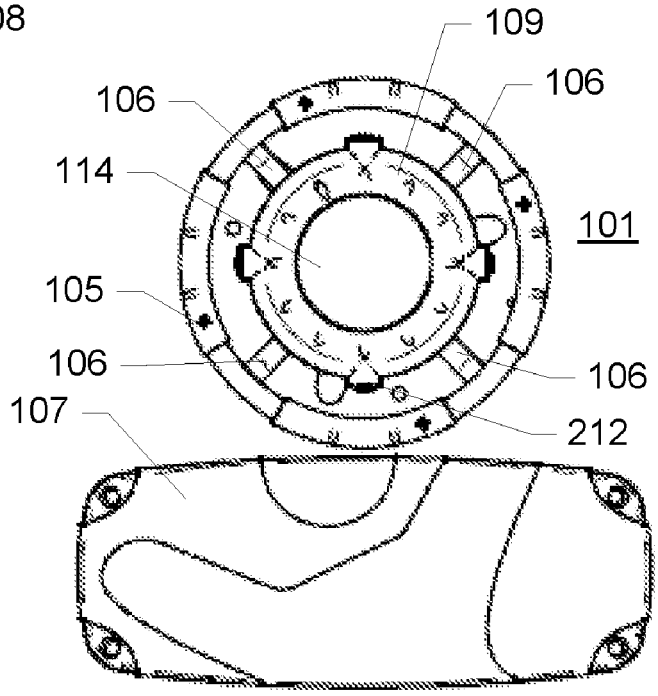

FIG. 1 shows a view of an example of an interactive playground system. The playground system comprises a play structure 100, a playground appliance 101, and a central control unit 140. FIG. 2*a* shows a side view of the playground appliance 101, and FIG. 2*b* shows a top view of the playground appliance 101.

The play structure 100 comprises a framework on which users can play and climb at various levels and elevations. The framework comprises various connecting/transport structures such as slides, chutes, climbing nets/platforms, ladders, etc. An example of such a play structure is disclosed in U.S. Pat. No. 6,095,950 which is incorporated herein by reference in its entirety. The play structure further comprises a plurality of user-interface elements 102 distributed across the play structure. An embodiment of such a user-interface element will be described in greater detail below.

The playground appliance 101 comprises a support structure on which a display unit 109 is mounted. The support structure comprises a base support in form of a base plate 103 from which an upright pole/column 104, e.g. a metal tube, extends. The base plate may e.g. be secured to a floor, a platform, a buried or cast anchor, a footing or other form of support or foundation by screws or the like. The display unit 109 includes a display 114. The display 114 provides a substantially horizontal display surface so as to allow several play participants grouped around the playground appliance an unobstructed view on the display.

The display unit 109 is a disk-shaped unit that may be constructed from a metal housing, e.g. of aluminum mountable on top of the pole 104, and covered by a protective cover, e.g. of rubber coated plastic. The display 114 may be a dot-matrix display or any other suitable display type. The display 114 may be protected by a transparent protective screen, e.g. of scratch resistant plastic or glass.

The display unit 109 is surrounded by a circumferential handle bar 105 substantially parallel to the screen 114 and connected to the pole 104 via bars/tubes 106 extending from the pole 104 at an acute angle so as to provide a protective framework around the display unit.

Figure 7:
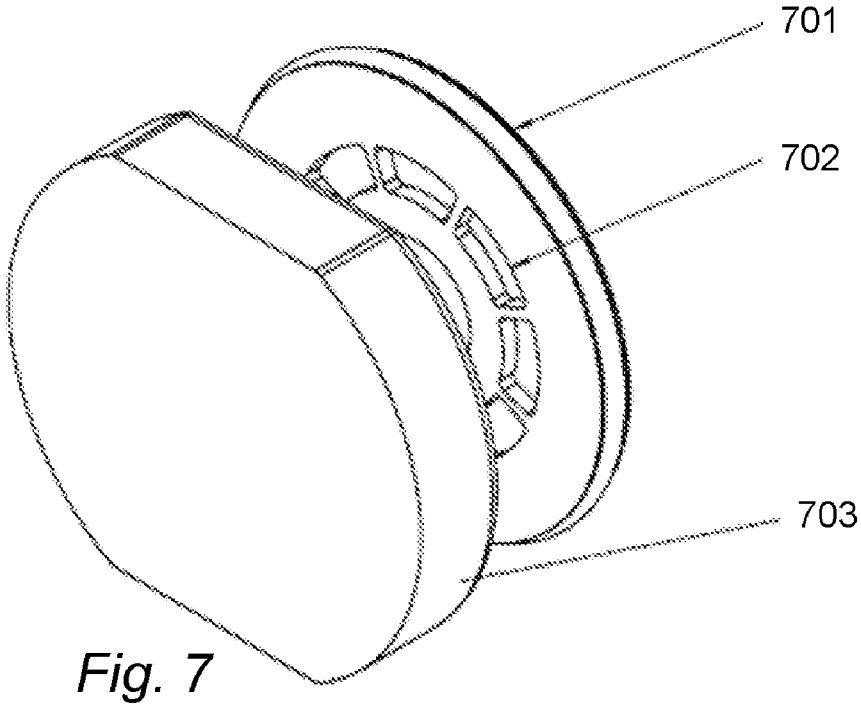
FIG. 7 shows an example of a rotation sensor for detecting rotation of a moveable, user-operatable support member

The playground appliance 101 further comprises an elongated board 107 of a size and shape suitable for a user to stand on. The board is mounted tiltable around a transversal axis 108 at the centre of the board so as to allow a spring-loaded tilt movement of the board caused by the user shifting the weight towards one side of the board. The board 107 is mounted at a height from the floor or ground that allows a user to easily step onto the board. The display 114 and the handle 105 are positioned at a height and distance from the board 107 that allow a user to conveniently hold on to the handle and view the display while standing on the board. The playground appliance comprises a tilt sensor (not explicitly shown), e.g. provided in an enclosure 213 under the board. The sensor is adapted to detect a tilt movement of the board and to generate a signal indicative of which side the board is tilted towards. The tilt sensor mechanism may include a number of position indicators, a rotation sensor, or a 1- or 2-axis accelerometer indicating movement with reference to the gravity force from the earth. The board 107 may also be fixed on a number of supports with built in force sensors (e.g. strain gauge based transducers). An example of a suitable rotation sensor is shown in FIG. 7. For example, the sensor may output a signal as long as the board is tilted more than a predetermined threshold. Alternatively or additionally, the sensor may generate a signal indicative of the direction and degree of the tilt.

The display unit 109 further comprises one or more push buttons 212 as an additional input device. The display unit 109 further comprises a processing unit (not explicitly shown) for controlling the display 114. The processing unit is further connected to the tilt sensor for detecting tilting of the board 107, and to the push button(s) 212, and the processing unit is programmed to control the display responsive to the received inputs from the push button(s) and the tilt sensor.

The central control unit 140 is connected to both the playground appliance 101 and the play structure 100, e.g. by a suitable bus system, or any other suitable wired or wireless communications interface. The central control unit may be implemented as a suitably programmed general-purpose computer, or a special-purpose control circuit. The central control unit is configured to receive inputs from the processing unit of the playground equipment 101 and the user-interface elements 102 of the play structure, and to control operation of the processing unit of playground appliance and the user-interface elements 102. An example of a control system for an interactive playground system will be described in greater detail in connection with FIG. 6

In use, a user may step onto the board 107 of the playground appliance 101 and press the button 212 so as to start the playground system. Upon start-up, the display may show a list of possible interactive activities, e.g. interactive games that can be played with the interactive playground system. The user may scroll back and forth through the list by tilting the board 107 in respective directions. For example, each time the sensor detects a tilt of the board to the right, the sensor may forward a corresponding signal to the processing unit of the display unit 109, thus causing the display unit to scroll the list one item to the right/down. Similarly, each time the tilt sensor detects a tilt of the board to the left, the display unit scrolls the list one item to the left/up. When the user has selected the desired activity, the user may again press the push button 212 to activate the selected activity. Some activities may be further configurable, e.g. so as to select a number of players or teams, a level of difficulty, a timer setting, and/or the like. Accordingly, the user may be guided to a sequence of further lists of selectable items and scroll through the list by operating the tiltable board 107, and selecting an item by pressing the push button 212. Once all parameters for a selected activity are set, the user may start the activity by pressing the button 212. The processing unit of the display unit 109 may forward the selected activity and optionally further parameters to the central control unit 140 which initiates the selected activity. The activity may involve the central control unit 140 activating the user-interface elements 102 of the play structure in a predetermined manner, e.g. responsive to inputs received by the user-interface elements 102 and based on a set of rules associated with the selected activity and implemented by the control unit. Examples of such activities may involve competitive games where users should find and activate user-interface elements that are illuminated in a random order as fast as possible, or activities involving different teams that should find and activate user-interface elements emitting light of respective colors, or the like. During and/or at the end of the interactive activity, the central control unit 104 may send feedback information to the display unit 109 for display of activity-related parameters, e.g. a countdown of the remaining time for the activity, a score, a winning team, and/or the like. It will be appreciated that numerous variations of activities may thus be programmed for any given play structure, thereby allowing a long lasting play experience for the users of the play structure.

In FIG. 1, the playground appliance 101 is shown as a separate device that is mounted on the ground or playground floor separately from the play structure 100. However, it will be appreciated that the playground appliance 101 may also be provided as an integral part of the play structure 101, e.g. by mounting the playground appliance on a platform of the play structure. Similarly, it will be appreciated that the central control unit 140 may be provided as a separate unit or integrated in the play structure or the playground appliance. For example, the central control unit may be provided in a separate enclosure positioned remote from the play structure and the playground appliance or in an enclosure integrated in the play structure or the playground appliance. It will further be appreciated that the control unit may also be provided as several distributed units, some or all of which may be integrated in respective ones of the play structure and the playground appliance.

It will further be appreciated that a playground system may comprise a number of additional or alternative functional elements, such as different output devices for outputting light or other visual effects, sounds, music or other audible effects, or any other user-detectable outputs, and/or different input devices for receiving user-inputs such as push buttons, switches, dials, etc.

Figure 3:
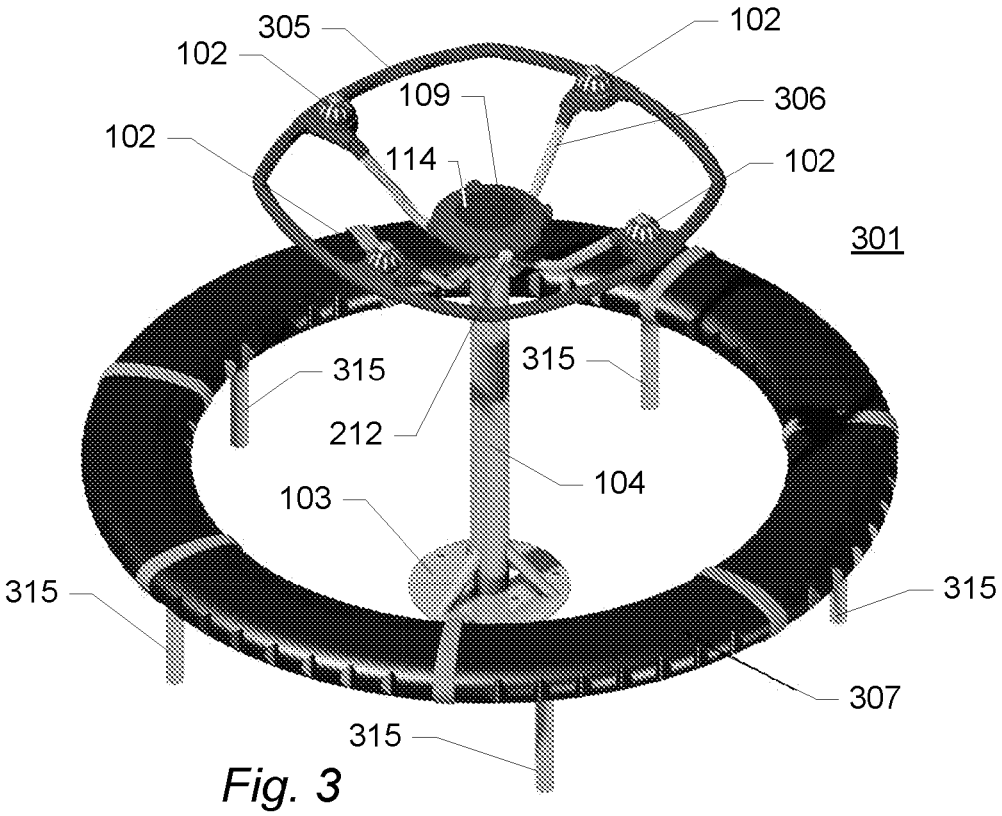

FIG. 3 shows another example of a playground appliance. The playground appliance 301 is similar to the playground appliance 101 of FIG. 1, and comprises a support structure on which a display unit 109 is mounted. The support structure comprises a base support in form of a base plate 103 from which an upright pole 104 extends as described in connection with FIG. 1.

Figure 5:
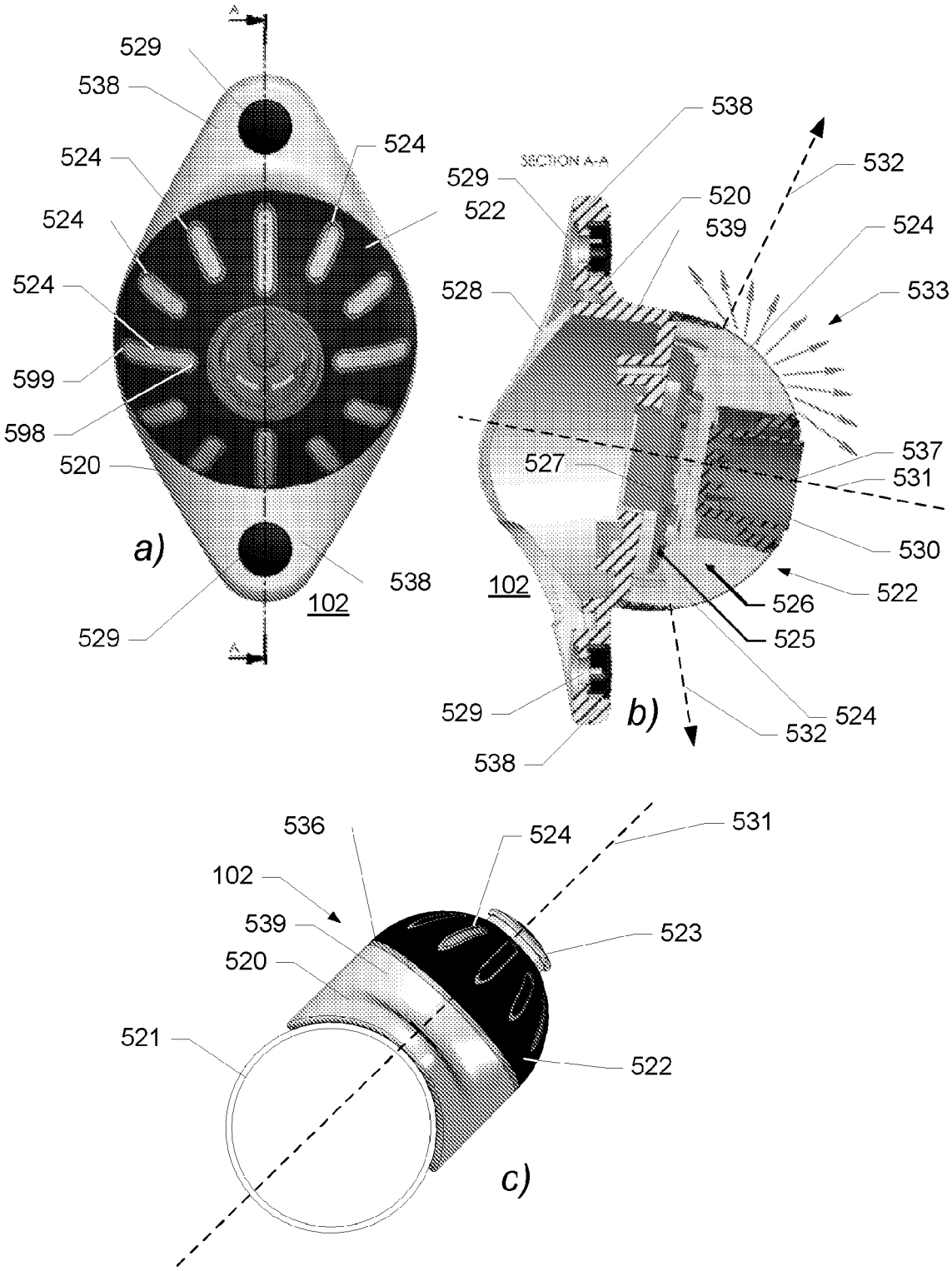
FIG. 5 shows an example of a user-interface element for playground equipment.

The display unit 109 comprises a screen 114, one or more push buttons 212, and a processing unit as described above. The display unit 109 is surrounded by a circumferential handle bar 305 defining a plane substantially parallel to the screen 114 and connected to the pole 104 via bars 306 extending from the pole. In the example of FIG. 3, a number of additional user-interface elements 102, e.g. as described in connection with FIG. 5, are provided along the handle bar 105. The user-interface element may be used during one or more of the configurable interactive activities.

The playground appliance 301 further comprises an annular platform 307 or ring revolvably arranged around the pole 104. The platform 307 has a width and shape suitable for a plurality of users to stand on. The annular platform 307 is mounted on legs 315 at a height from the floor or ground that allows a user to easily step onto the annular platform.

The display 114 and the handle 105 are positioned at a height and distance from the board 107 that allow users to conveniently hold on to the handle and view the display while standing on the annular platform. In particular, the handle bar 305 is similar to the handle bar 105 of FIG. 1 but has a larger diameter in accordance with the distance between the annular platform 307 and the pole 104 being larger than the distance between the tiltable board 107 and the pole 104 in FIG. 1.

The annular platform 307 is mounted revolvable/rotatable around the pole 104. For example the annular platform may be mounted on guide wheels movably along a fixed annular guide member supported by the legs 315. An example of such a revolvable platform is disclosed in U.S. Pat. No. 7,001,311 which is incorporated herein by reference in its entirety. The playground appliance comprises a sensor (not explicitly shown), e.g. provided in an enclosure under the platform 307. The sensor is adapted to detect a rotation of the annular platform and to generate a signal indicative of the direction and speed of rotation. The sensor may be any suitable type of sensor for detecting the direction and speed of the revolving platform. For example, the rotation may be detected by one or more Hall effect sensors, e.g. as described in connection with FIG. 7.

The processing unit of the display unit 109 is connected to the sensor for detecting movement of the annular platform 307, to the push button(s) 212, and to the user-interface elements 102. The processing unit is programmed to control the display responsive to the received inputs from the push button (s) 212, the sensor, and optionally the user-interface elements 102.

Figure 4:
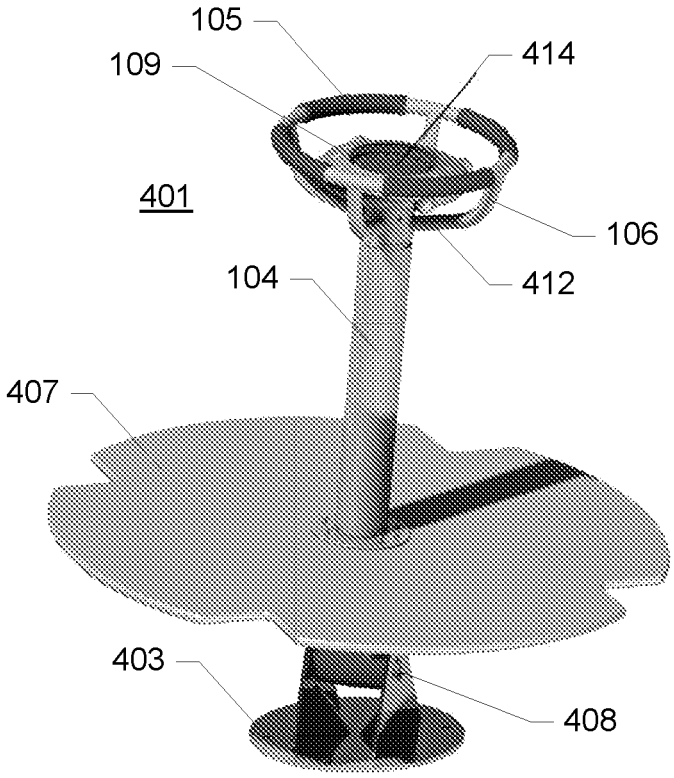

FIG. 4 shows yet another example of a playground appliance 401. The playground appliance of FIG. 4 is similar to the playground appliance 101 of FIG. 1, and comprises a display unit 109 mounted on a tubular pole 104 and surrounded by a handle 105, as described in connection with FIG. 1.

The playground appliance 401 differs from the playground appliance 101 in that the pole 104 is tiltably mounted to a base plate 403 allowing the pole to perform a spring-loaded tilt motion around an axis 408. The playground appliance 401 further comprises a platform 407 connected to the pole 104 such that the pole projects though the platform 407. Hence, in the embodiment of FIG. 4, a user can cause a tilt movement of the entire upper structure by standing on the platform 407, holding on to the handle 105 and shifting the user's weight in the desired direction. The playground appliance 401 comprises a tilt sensor (not explicitly shown) adapted to detect a tilt of the platform and pole and to generate a signal indicative of which side the platform is tilted towards.

FIG. 5*a* shows an example of a user-interface element, generally designated 102, for playground equipment. FIG. 5*b* shows a sectional view of the user-interface element 102, and FIG. 5*c* shows the user-interface element 102 mounted on a tube 521. The user-interface element 102 comprises an aluminum housing/base part 520 and a convex or generally dome-shaped front cover 522. The dome has a circumferential edge 536 defining a base plane. A push-button 523 is provided in the centre of the dome-shaped front cover surface.

The housing 520 comprises a tubular base part 539 having a front edge that provides a circumferential, e.g. circular, support for supporting the front cover 522 along the circumferential edge of the dome. The front cover 522 is secured by a suitable coupling to the tubular base part, e.g. by means of a snap-fit coupling, screws, or the like. The outer surface of the tubular base part 539 extends substantially tangential from the outer surface of the dome-shaped front cover 522 at the base of the dome-shaped front cover. The dome-shaped front cover may be made of a suitable plastic, e.g. rubber-coated plastic, and it includes a recess 530 for receiving a push button 523 (not shown in FIGS. 5*a-b*). The recess is located at the centre of the dome-shaped front cover and allows the push button 523 to be actuated along a principally forward direction along axis 531 defined by the centre of the base of the dome and the centre of the surface of the dome. Thus the button 523 may be regarded as defining a pole 537 of the dome-shaped front cover.

The housing 520 includes a circuit board 527 at the base of the dome-shaped front cover 522. The circuit board comprises control circuitry, e.g. a suitably programmed microprocessor, a sensor circuit for detecting actuation of the push button 523, and a number of light-emitting diodes (LED) 525 or other suitable light source, e.g. arranged in a circular pattern. The circuit board may receive electrical power and have a wired data interface via wires entering the housing 520 from the rear through the tubular base part 539. The sensor circuit may be any suitable device for sensing actuation of the push-button. For example, a contact-less detection may be provided by a Hall effect sensor detecting the proximity of the push button 523 when actuated.

The light emitted by the LEDs 525 is guided through a light guide 526 towards a number of light-emitting areas 524 of the dome-shaped front cover. The light guide 526 is mounted in the housing 520 in front of the circuit board 527. The dome-shaped front cover 522 has a number of holes or transparent sections, and the light guide member 526 has a corresponding number of guide sections that have front surfaces covering the holes or transparent sections so as to guide the light from the LEDs to the holes or transparent sections, causing the holes or transparent sections to function as light-emitting surface parts 524 of the dome-shaped front cover. The light-emitting surface parts 524 may have a variety of shapes and dimensions, and they may be arranged in a variety of patterns. When at least some of the light-emitting surface parts extend at least to the vicinity of the circumferential edge 536 of the dome, and at least some of the light-emitting surface parts extend at least to the vicinity of the centre or pole 537 of the dome, the emitted light may be emitted to a wide range of angles, and is visible both from the front of the user-interface element and from the rear. The light guide 526 contributes to this large viewing angle by scattering the emitted light, so as to provide a diffuse light emission in a large range of directions as illustrated in FIG. 5*b* by arrows 533. In the example of FIG. 5, the light-emitting surface parts 524 are arranged in a circumferential pattern on the dome-shaped surface around the pole 537, and each of the light-emitting surface parts has an elongated shape in the form of a strip extending from a pole end 598 proximal to the push button 523 to a base end 599 in the vicinity of the circumferential edge of the dome shaped front cover. Consequently, light is emitted into all radial directions and over a large range of angles relative to the forward direction 531.

When the surface normals 532 at the parts of the light-emitting surface parts 524 most proximal to the circumferential edge 536 of the dome define an angle relative to the forward direction 531 of no less than 30 degrees, preferably no less than 40 degrees, e.g. approximately 45 degrees, the emitted light may be seen over a viewing angle of approximately 240 degrees, preferably approximately 260 degrees, e.g. approximately 270 degrees.

The housing 520 further provides a suitable fitting for mounting the housing to an element of a play structure such as a tube, beam or the like. In the example of FIG. 5, the tubular part 539 of the housing has a rear edge 528 opposite the circular support for the front cover shaped to abut to a tube 521. The housing 520 comprises two tabs 538 protruding outwardly from the tubular base part 539 in opposite directions, each tab comprising a bore 529 for connecting the tabs to a tube 521, e.g. via screws. In the example of FIG. 5, the tabs 538 protrude from the tubular base part 538 at an angle different from 90 degrees relative to the forward axis. As the tubular base part 539 of the housing extends tangentially from the dome-shaped front cover 522, the light emitted in a rearward direction from the front cover is not blocked by the tubular base part 539. As can be seen from FIG. 5*c*, when the diameter of the tubular base part 539 matches to or is no less then the diameter of the tube 521 to which the user-interface element 102 is mounted, an observer on the rear side of the tube 521 almost opposite the side on which the user-interface element 102 is mounted may still be able to see the light emitted from the user-interface elements.

It will be appreciated that the user-interface element 102 may comprise LEDs of different color, thus allowing the user-interface element to be controlled to selectively emit colored light. Similarly, when the user-interface element 102 includes respective LEDs associated with each light-emitting surface part 524, and respective light guides or light guide portions arranged to direct light from a specific set of LEDs to the corresponding light-emitting surface part, the user-interface element may be controlled to selectively illuminate only some or all of the light-emitting surface area parts.

Figure 6:
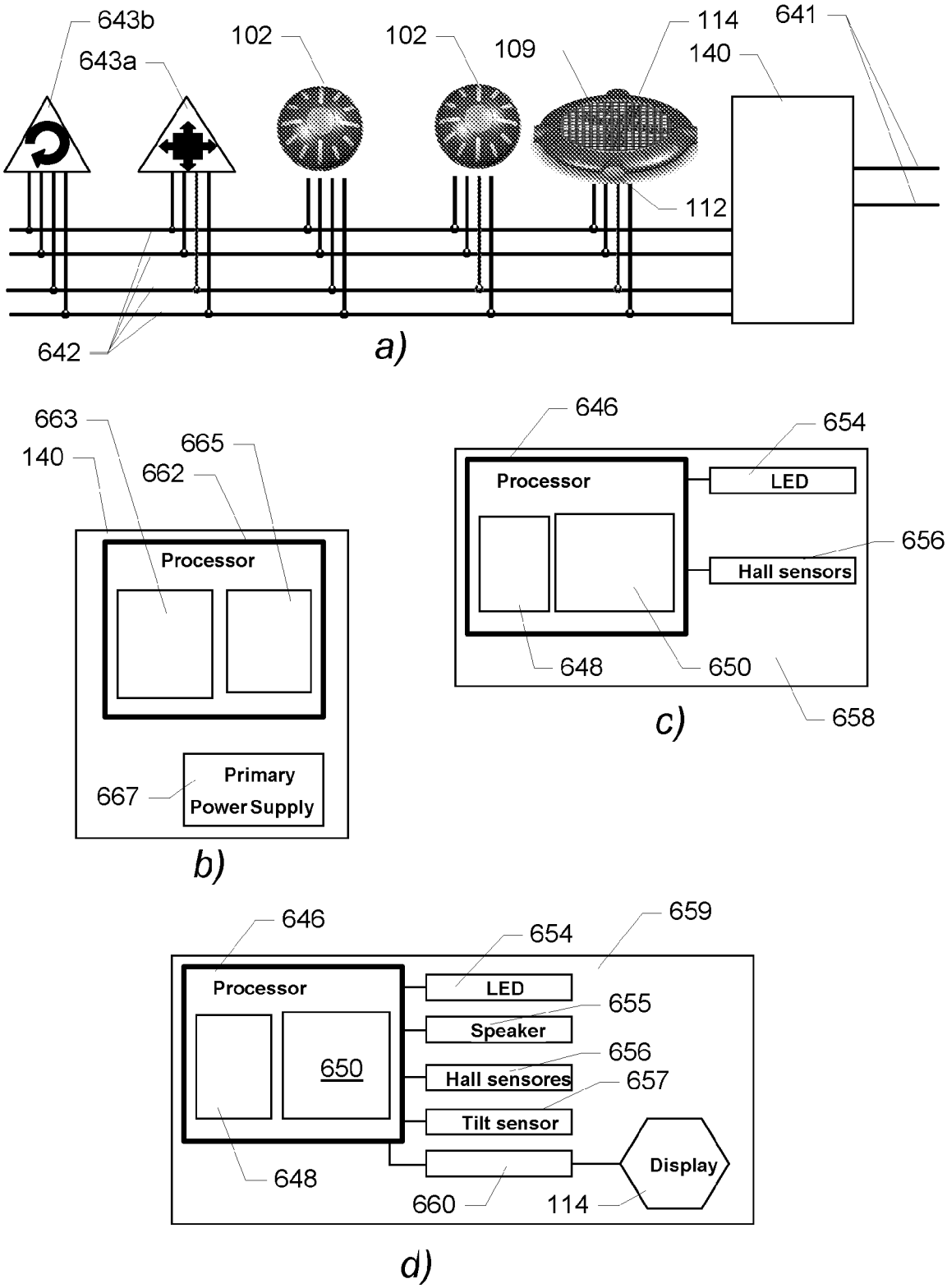
FIG. 6 shows a schematic block diagram of an example of a control system for an interactive playground system.

FIG. 6 shows a schematic block diagram of an example of a control system for a playground system. FIG. 6*a* schematically illustrates the overall control system, while FIGS. 6*b-d* show block diagrams of the control units included in the respective components of the system.

The control system comprises a central control unit 140, a display unit 109 of a playground appliance as described herein, a set of user-interface elements such as sensor units 643 and/or user-interface elements 102 as described in connection with FIG. 5. In the example of FIG. 6*a*, one display unit 109, two user-interface elements 102, one rotational sensor 643*b* and one tilt sensor 643*a* are shown. However, it will be appreciated that these numbers only server for illustrational purposes and that a playground system may include different numbers of some or all of these elements.

The central control unit 140 receives electrical power via lines 641. A bus system 642 connects the central control unit 140 with the other control elements of the system, i.e. the display unit(s) 109, the user-interface element(s) 102, and the sensor(s) 643. The bus system 642 is a 4-wire bus and provides electrical power from the central control unit 140 to the other devices as well as data communication between the devices and the central control unit. The bus system, 642 may use any suitable bus technology, e.g. a Controller Area Network (CAN) bus system.

FIG. 6*b* shows a block diagram of an example of the central control unit 140. The central control unit 140 comprises a processing unit 662, e.g. a microprocessor-based control unit, and a power supply 667 for supplying the central control unit and the other devices of the control system with electrical power. The processing unit 662 may be operated under the control of a suitable operating system, e.g. a LINUX operating system or the like. The processing unit 662 includes a bus interface controller 665 for controlling communication over the bus system 624, and a processing logic block 663 suitably programmed to control the overall operation of the playground system.

FIG. 6*c* shows a block diagram of an example of the control unit 658 of a user-interface element 102. For example, the control unit may be implemented on the circuit board 527 of the user-interface element shown in FIG. 5. The control unit 658 comprises a processing unit 646, e.g. a microprocessor-based control unit. The control unit 658 further comprises one or more LEDs 654 for providing light feedback, and a Hall effect sensor 656 for detecting actuation of a push button as described in connection with FIG. 5, each connected to the processing unit 646. The processing unit 646 includes a bus interface controller 648 for controlling communication over the bus system 624, and a processing logic 650 for controlling the function of the user-interface element 102.

FIG. 6*d* shows a block diagram of an example of the control unit 659 of a display unit 109. The control unit 659 comprises a processing unit 646 similar to the processing unit described in connection with FIG. 6*c*. The control unit 659 further comprises one or more LEDs 654 for providing light feedback, a loudspeaker 655 for providing acoustic feedback, one or more Hall effect sensor(s) 656 and/or a tilt sensor 656, and a display controller 660 for controlling the display 114, each connected to the processing unit 646. The Hall effect sensor (s) 656 and/or tilt sensor 657 are arranged to detect movement of a moveable support member, e.g. a tiltable board, or revolvable annular platform as described herein. Furthermore, a Hall sensor may be used to detect actuation of a push button 212 of the display unit 109.

FIG. 7 shows an example of a rotation sensor for detecting rotation of a moveable, user-operatable support member, e.g. the annular platform 307 of FIG. 3. The sensor includes a wheel 701 fitted with a number of permanent magnets 702. The wheel is arranged so as to be brought in rotation through the movement of the user-operatable support member caused by a user activity. The permanent magnets 702 in the revolving wheel 702 may thus activate hall sensors in a static electronic device 703. The hall sensors may thus generate a detector signal indicative of the speed and direction of rotation. For example, the wheel 701 may be mounted rotatable around the tilt axis 108 of the board 107 in FIG. 1. Similarly, when used with the playground appliance of FIG. 3, the wheel 701 may be mounted on an axle such that the wheel 701 is in frictional contact with the revolvable platform 307 and is rotated when the revolvable platform 307 revolves.

Figure 8:
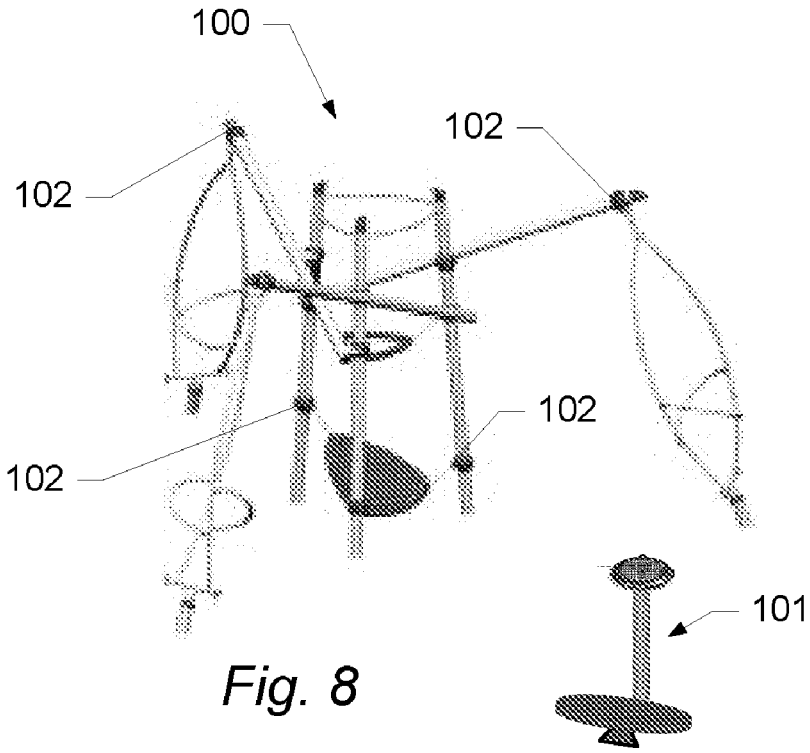
FIG. 8 shows a view of another example of an interactive playground system.

FIG. 8 shows a view of another example of an interactive playground system. The playground system comprises a play structure 100, a playground appliance 101, and a central control unit (not explicitly shown). The playground system is similar to the one shown in FIG. 1, and will not be described in greater detail again.

For the production of the individual parts of embodiments of the playground system described herein use may be made of suitable materials such as steel, and/or aluminum, and/or an alloy for the columns/poles, framework structures etc. the platforms may be made of suitable wooden plates, such as a laminate or other suitable furniture plate, or of plastic.

Although some embodiments have been described and shown in detail, the invention is not restricted to them, but may also be embodied in other ways within the scope of the subject matter defined in the following claims. For example, it will be appreciated that, in some embodiments, a playground structure may be integrated in the playground appliance. For example, the playground appliance may include user-interface elements in addition to the moveable support member, and the playground appliance may be used for playing interactive games in addition to configuring/initiating such games as described above. Alternatively or additionally, the moveable support member and/or the display may function as a user-interface element during an interactive game. For example, the playground appliance may provide visual or audible feedback responsive to a speed and/or direction pattern in which a user activates the moveable support member.

In the apparatus claims enumerating several means, several of these means can be embodied by one and the same element, component or item of hardware. The mere fact that certain measures are recited in mutually different dependent claims or described in different embodiments does not indicate that a combination of these measures cannot be used to advantage. It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. A playground system, comprising:

a processing unit: and a playground appliance, wherein the playground appliance comprises:

a display operationally connected to the processing unit and adapted to display one or more user-selectable items;

a support structure for securing at least a part of the playground appliance to a surface;

a support member for supporting a user of the playground appliance, wherein the entire support member is movably arranged relative to the support structure responsive to a kinetic energy imparted by the user; and a sensor operationally connected to the processing unit and adapted to detect a movement of the support member, wherein:

the support member is configured to support an entire weight of the user, the entire support member is movable arranged relative to the support structure when supporting the entire weight of the user, the processing unit is adapted to receive a sensor signal from the sensor indicative of the detected movement, and to control the display to indicate a user-selection responsive to the received sensor signal, and the processing unit is further adapted to control the display to display one or more user-selectable items of a list of user-selectable items, and to scroll through the list responsive to the detected sensor signal.

2. The playground system according to claim 1, wherein the support member comprises a platform on which the user can stand.

3. The playground system according to claim 1, wherein the sensor is further adapted to detect a direction of the movement.

4. The playground system according to claim 1, wherein the sensor is further adapted to detect a speed of the movement.

5. The playground system according to claim 1, wherein the sensor is further adapted to detect a degree of displacement of the support member caused by the movement.

6. The playground system according to claim 1, wherein the movement includes a tilt motion.

7. The playground system according to claim 1, wherein the movement includes a rotation.

8. The playground system according to claim 1, further comprising one or more user-interface elements with each user-interface element being operationally connected to the processing unit, and the processing unit being adapted to control each of the user-interface elements, wherein the user-interface elements comprise:

a housing including a rear surface mountable on the playground appliance;

a front cover including a convex front surface having a center axis defining a forward direction, the front surface comprising at least one light-emitting front surface part having a surface normal at an angle relative to the forward direction; wherein said angle is larger than 30 degrees.

9. The playground system according to claim 8, wherein said angle is no smaller than 40 degrees, preferably no smaller than 45 degrees.

10. The playground system according to claim 8, wherein the user-interface element comprises a user-operatable input device for receiving a user input.

11. The playground system according to claim 8, wherein the input device comprises an actuator member defining a principle direction of actuation along the forward direction.

12. The playground system according to claim 8, comprising a light source and a light guide adapted to direct light emitted by the light source through the light-emitting surface part.

13. The playground system according to claim 12, wherein the light guide is adapted to scatter the light so as to provide a diffuse light emission from the light-emitting surface part.

14. The playground system according to claim 8, wherein the convex front surface is a spheroidal or spherical dome.

15. The playground system according to claim 8, wherein the front surface comprises a plurality of elongated light-emitting surface parts each having a proximal end portion, proximal to a centre axis of the convex surface, and a distal end portion, proximal to a circumferential edge of the convex surface.

16. The playground system according to claim 8, wherein the housing comprises a front portion providing a circumferential mounting member for connecting the circumferential edge of the front cover, and a side wall substantially tangential to the convex surface along the circumferential edge.

17. The playground system according to claim 8, wherein the housing comprises a base portion for mounting the user-interface element to an elongated member defining a longitudinal axis, and wherein the principle direction of actuation defines an acute angle to the longitudinal axis.

18. The playground system according to claim 1, wherein the support member is a singular member and controls the playground appliance in a bi-directional manner.

19. A playground system comprising:

a processing unit, a play structure, a control unit, and a playground appliance, wherein the playground appliance comprises:

a display operationally connected to the processing unit and adapted to display one or more user-selectable items;

a support structure for securing at least a part of the playground appliance to a surface;

a support member for supporting a user of the playground appliance, wherein the entire support member is movably arranged relative to the support structure responsive to a kinetic energy imparted by the user; and a sensor operationally connected to the processing unit and adapted to detect a movement of the support member, wherein:

the support member is configured to support an entire weight of the user, the entire support member is movable arranged relative to the support structure when supporting the entire weight of the user, the processing unit is adapted to receive a sensor signal from the sensor indicative of the detected movement, and to control the display to indicate a user-selection responsive to the received sensor signal, and the play structure comprises a framework on which users can play and climb, and a plurality of user-interface elements distributed across the play structure, and wherein the control unit is configured to receive an input indicative of the user-selection from the processing unit of the playground appliance, and to control operation of the processing unit of the playground appliance and the user-interface elements responsive to the user-selection.

* * * * *